US005813555A

United States Patent [19]

Grigsby, Sr.

[11] Patent Number: 5,813,555

[45] **Date of Patent: *Sep. 29, 1998**

[54] WING-END CLEATED CRATE

[75] Inventor: John M. Grigsby, Sr., Marietta, Ga.

[73] Assignee: North American Container Corporation, Mableton, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 560,463

[22] Filed: Nov. 17, 1995

[51] Int. Cl.[6] ..... B65D 6/18; B65D 6/24; B65D 85/68

[52] U.S. Cl. ..... 217/38; 53/396; 53/452; 217/16; 217/43 R; 217/45; 217/48

[58] Field of Search ..... 217/38, 16, 48, 217/65, 36, 45, 3 BC, 12 R, 13, 12 A, 17, 43 R, 43 A; 220/1.5, 6, 9.2, 401, 4.28; 229/23 C, 199; 53/396, 452

[56] References Cited

U.S. PATENT DOCUMENTS

| | | | |
|---|---|---|---|
| 939,026 | 11/1909 | Howland | 229/23 C |
| 1,787,305 | 12/1930 | Campbell | 217/36 |
| 1,895,624 | 1/1933 | Hingston . | |
| 2,042,323 | 5/1936 | Ott | 217/16 |
| 2,110,150 | 3/1938 | Hile | 217/16 |
| 2,141,497 | 12/1938 | Watkins | 217/48 |
| 2,159,642 | 5/1939 | Watkins | 217/48 |
| 2,316,854 | 4/1943 | George et al. . | |
| 2,317,613 | 4/1943 | Hull et al. | 217/36 |
| 2,488,692 | 11/1949 | Talbot . | |
| 2,525,838 | 10/1950 | Smith et al. | 217/16 |
| 3,136,472 | 6/1964 | Waller et al. . | |
| 3,727,786 | 4/1973 | Fausel | 229/23 C X |
| 4,120,417 | 10/1978 | Aquino | 220/401 X |
| 4,383,609 | 5/1983 | Lochmiller | 229/23 C X |
| 4,832,256 | 5/1989 | Grigsby . | |
| 5,398,832 | 3/1995 | Clive-Smith | 220/6 X |

FOREIGN PATENT DOCUMENTS

| | | | |
|---|---|---|---|
| 500520 | 3/1954 | Canada | 217/36 |
| 544415 | 8/1957 | Canada | 220/401 |
| 68832 | 6/1958 | France | 229/23 C X |
| 154055 | 11/1920 | United Kingdom . | |
| 311983 | 5/1929 | United Kingdom . | |

*Primary Examiner*—Allan N. Shoap
*Assistant Examiner*—Niki M. Kopsidas
*Attorney, Agent, or Firm*—Kennedy, Davis & Kennedy

[57] ABSTRACT

The present invention provides a cleated crate for packaging, storing, and shipping heavy articles. The cleated crate includes a base frame for supporting an article to be packed, a pair of wing-end frames that define ends and side portions of the cleated crate. The wing-end frames comprise a pair of hinge corners each having a pair of spaced apart cleats attached to a fibreboard plate with a score along an axis. The fibreboard plate folds on the score to define a corner post of the cleated crate. A portion of the side of the cleated crate is defined by a side member and a support member attached to one of the pairs of cleats on the fibreboard plate. Elongate members connect two hinge corners together to define a wing-end frame. A pair of wing-end frames are positioned and attached to opposite ends of a base frame or pallet. Intermediate connectors rigidly connect on opposite sides to aligned hinge corners at the opposite ends of the cleated container. A top frame is dimensioned for receipt by the wing-end frames in the intermediate connectors.

8 Claims, 2 Drawing Sheets

WING-END CLEATED CRATE

TECHNICAL FIELD

The present invention relates generally to cleated crates. More particularly, the present invention relates to cleated crates assembled from two unitary wing-end frames that each define portions of the sides and ends of the crate.

BACKGROUND OF THE INVENTION

Packaging of heavy, bulky machinery such as lawn and garden tractors, lawn mowers, snow mobiles, boat motors, engines, air conditioners, and the like, presents many unique considerations. Because such machinery is by its nature difficult to handle and store, containers have been developed to meet the need of protectively enclosing the machinery while providing sufficient strength to enable several of the containers to be stacked in order to conserve warehouse space and truck space during shipping. The containers developed for packaging such machinery include cleated crates and corrugated paperboard wall containers having cleat reinforcements.

The conventional cleated crate includes two side frames and two end frames having a plurality of cleats and slats. The sides and end frames connect to a base pallet that supports the article in the crate and a top frame. The six pieces are secured together with nails, staples, or screws.

Corrugated paperboard containers were developed to provide closed wall protection for articles held in the container. The conventional wood-cleated corrugated paperboard container consists of a corrugated paperboard body, a top frame, and a base frame. Generally the interior walls of the corrugated paperboard body are provided with wood reinforcement cleats that are vertically aligned. The cleats contact the base and top frames to provide stacking strength. The corrugated paperboard body gives the container definition and maintains the position of the wood reinforcement cleats. The base frame or pallet supports the container and the article packed therein. The top frame closes off the container and provides a surface upon which another container may be stacked.

While these containers have met the need for packaging heavy articles, there are drawbacks which limit their use. The cleated container is more difficult to assemble. It comprises a number of parts which are also labor intensive to assemble together during packaging. The wood components are relatively inexpensive and the labor costs for assembly are relatively high compared to the material and labor costs for corrugated paperboard containers. Generally paperboard containers are more expensive than a cleated container, but assembly of such containers during packaging of heavy articles is typically easier and less labor intensive. Further, some articles do not need the closed wall protection provided by the corrugated paperboard container.

Cleated containers have other drawbacks as well. The side frames and end frames typically are aligned by eye by packing line assemblers who are working under time pressure. Stapling a misaligned side to the base results in a crate being assembled out of square. This greatly weakens the assembled pack. Also, labeling and identification of the product and advertising is more difficult with cleated containers as opposed to corrugated paperboard containers, which provide a broad surface for printing, advertising, and product information. Conventional cleated containers lack printable surfaces and typically rely on paper labels being stapled to the sides. These labels are easily torn off during handling, resulting in misidentified products.

Accordingly, there is a need in the art for an improved cleated container which is more easily assembled for enclosing articles while providing stacking and handling strength features. It is to the provision of such that the present invention is primary directed.

SUMMARY OF THE INVENTION

The present invention meets the need in the art by providing a wing-end corner for a cleated container. The wing-end cleated corner comprises a plate having a score along an axis thereof and a pair of cleats attached to the fibreboard plate and spaced-apart from the score to define a gap between the cleats. The wing-end corner, being folded on the score forms a corner post for a cleated container.

In another aspect, the present invention further meets the need in the art by providing a unitary frame for side and end portions of a cleated container. The unitary frame comprises two hinge corners that are joined together by elongate members. Each hinge corner comprises a fibreboard plate having a score along an axis thereof and a pair of cleats attached to the fibreboard plate and spaced-apart from the score to define a gap between the cleats. The fibreboard plate folds on the score as a hinge to dispose the cleats at intersecting planes relative to each other. A side frame, or wing, attaches to each hinge corner. The side frame comprises at least one side member rigidly attached at one end to a first one at the pair of cleats and extends laterally thereof. A support member extends diagonally between the first one of the pair of cleats and a distal end of the side member.

A pair of spaced-apart elongated members interconnect the two hinge corners to define the unitary wing-end frame. The members rigidly join at distal ends to respective second ones of the pair of cleats on the respective hinged corners. An end support member extends diagonally between the second ones of the pair of cleats on the hinged corners. The unitary frame lays flat for shipment and defines sides and end portions of a cleated container by folding the hinge corners on their respective scores in a first direction and connecting the unitary frame to a base frame of the container.

In another aspect, the present invention meets a need in the art by providing a cleated crate formed by attaching a pair of opposing wing-end frames to a base frame for supporting an article to be packed. Each wing-end frame comprises two hinge corners interconnected by elongate members. Each hinge corner comprises a fibreboard plate having a score along an axis thereof. A pair of cleats attach to the fibreboard plate and are spaced-apart from the score to define a gap between the cleats. The fibreboard plate folds on the score as a hinge to dispose the cleats at intersecting planes relative to each other to define corner posts for the cleated crate. A side frame is made of at least one side member rigidly attached at one end to one of the pair of cleats and extends laterally thereof. A support member extends diagonally between the one of the pair of cleats and a distal end of the side member.

A pair of spaced-apart elongated members interconnect the two hinge corners by being rigidly joined at distal ends to respective other ones of the pair of cleats on the hinge corners. An end support member extends diagonally between the other ones of the pair of cleats on the hinge corners. The unitary wing-end frames fold on the scores and connect to the base frame to define sides and end portions of a cleated container. A top frame dimensioned for receipt by the wing-end frames and the intermediate connectors is secured to an upper end of the frames.

DETAILED DESCRIPTION

Figure 1:
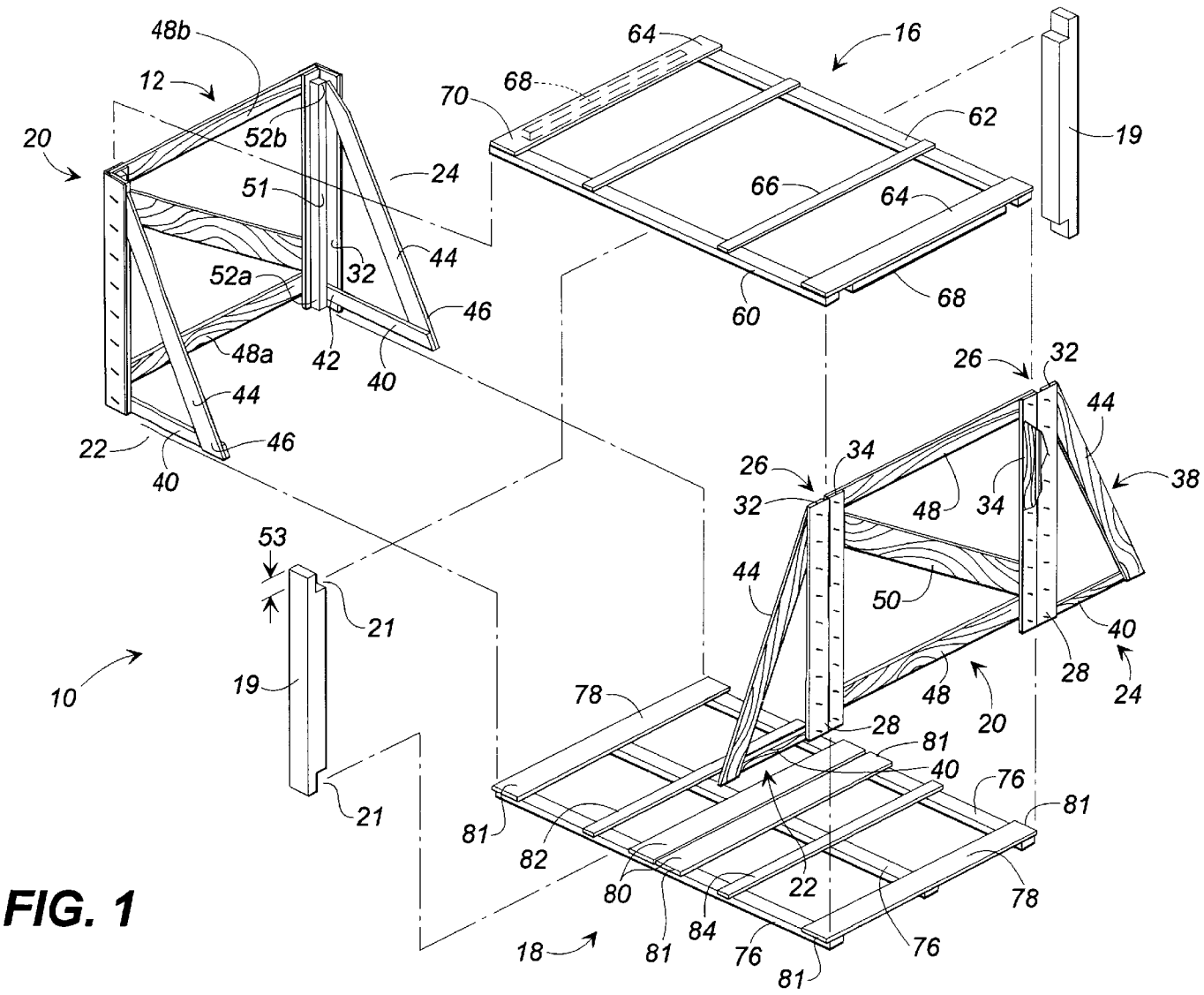
FIG. 1 is an exploded perspective view of a wing-end frame cleated crate according to the present invention.

Referring now in more detail to the drawings, in which like numerals indicate like parts throughout the several views, FIG. 1 shows an exploded perspective view of a wing-end cleated crate 10 according to the present invention. The crate 10 assembles from a pair of unitary wing-end frames 12 that connect to a top frame 16 which is illustrated exploded away above the wing-end frames and a bottom frame 18 exploded away therebelow. A center vertical cleat 19 connects between the bottom frame 18 and the top frame 16 intermediate the wing-end frames 12. The vertical cleat 19 has notched ends 21 for matingly engaging members of the bottom and top frames, as discussed below.

Each wing-end frame 12 defines an end generally designated 20 and portions of opposing sides 22 and 24 of the cleated crate 10. The wing-end frame 12 accordingly forms a unitary frame for the side and end portions of the wing-end crate 10. The wing-end frame 12 comprises a pair of hinge corners generally designated 26 which are interconnected together by elongate end members discussed below. Each hinge corner 26 comprises a plate 28 having a score 30 along a longitudinal axis. The plate 28 in a preferred embodiment is made from a fibreboard sheet, although other materials such as plastic corrugated sheet can be used. Such material, while generally more expensive than corrugated paperboard, better resists deterioration and is suitable for crates having articles for out-doors storage. In an especially preferred embodiment the plate 28 is made of 90 pound test fibreboard sheet. A pair of cleats 32 and 34 attach to the fibreboard plate 28. The cleats 32 and 34 are spaced-apart from the score 30 (illustrated in FIG. 2) to define a gap 36 between the cleats.

A side frame, or wing, generally designated 38 attaches to the cleat 32 of the hinge corner 26. The side frames 38 define portions of the opposing sides 22 and 24 of the crate 10. The side frame 38 in the embodiment of FIG. 1 comprises one side member 40 rigidly attached at a first end 42 to the cleat 32 on the fibreboard plate 28. The side member 40 extends laterally from the cleat 32. A support member 44 extends diagonally between the cleat 32 and a distal end 46 of the side member 40. The diagonal support 44 is rigidly attached at respective distal ends to the cleat 32 and the side member 40.

The wing-end frame 12 assembles from two of the hinge corners 26 described above. A pair of spaced-apart elongated end members 48 interconnect the two hinge corners 26. The distal ends of the respective end members 48 rigidly connect to a respective one of the cleats 34 attached to the paperboard plates 28. An end support member 50 extends diagonally between the opposing cleats 34 of the pair of hinge corners 26 comprising the wing-end frame 12. A pair of interior cleats 51 rigidly attach at distal ends 52 to the interior faces of the upper and lower end members 48. The lower distal end 52*a* is flush with a lower edge of the lower end member 48*a*. The upper distal end 52*b* is recessed from an upper edge 54 of the upper end member 48*b*. The depth 53 of the recess equals the thickness of the long runner 62 of the top frame 16, so that the top frame runner 62 sits flush in the upper end of the crate 10. The top frame cross pieces 64 and 66 preferably overhang the exterior faces of the runners 62 and thereby sit on top of the wings 38. The resulting unitary frame 12 defines the end 20 and portions of the opposing sides 22 and 24. The frame 12 lays flat for shipment from the crate manufacturer to the manufacturer of products to be packed in the crate 10. The wings 38 also fold back over the end 20 to make a more compact knocked-down unit for shipping and handling.

Figure 2:
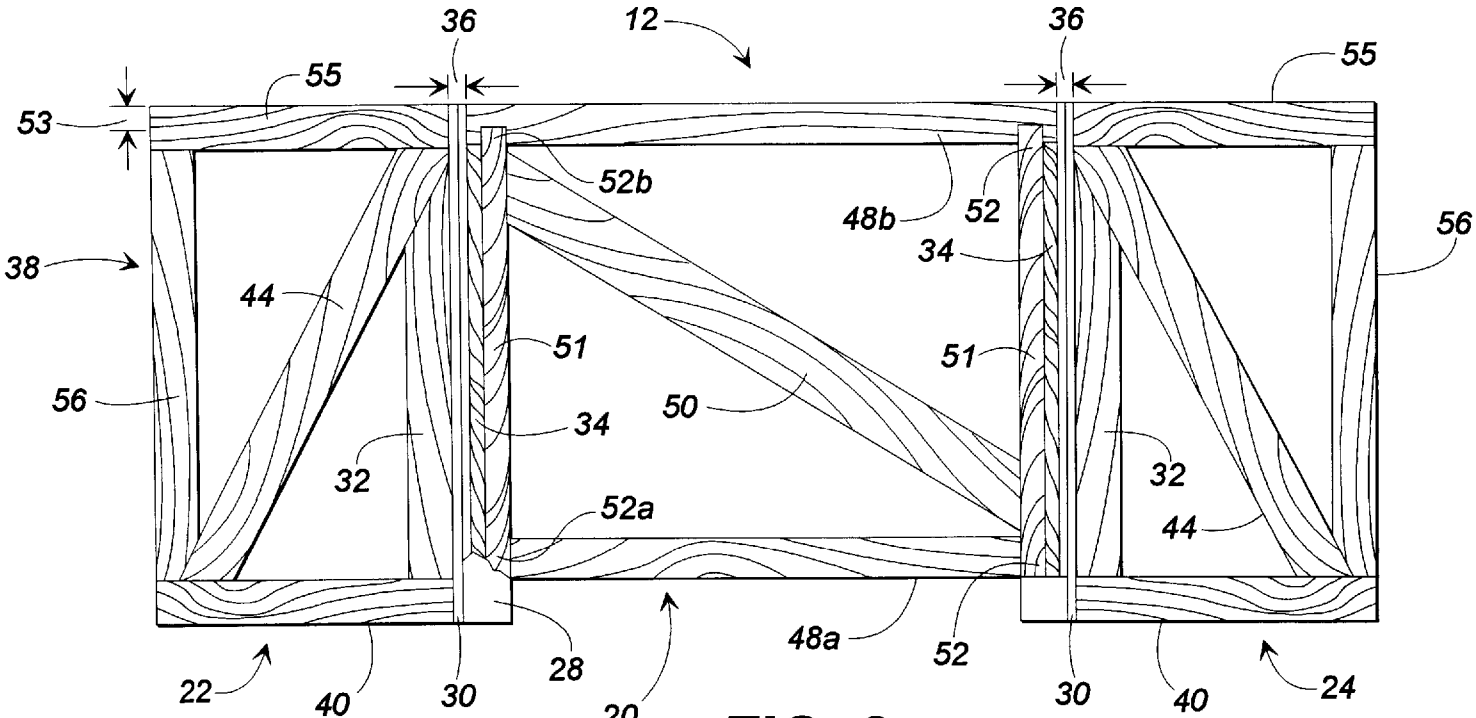
FIG. 2 is a plan view of an alternate embodiment of a wing-end frame for use in the cleated crate illustrated in FIG. 1.

FIG. 2 illustrates an alternate embodiment of the wing-end frame 12 in which the side frames 38 have additional support members. An upper side member 55 connects at a distal end to the diagonal support member 44 and the cleat 32. The upper support member 55 extends outwardly parallel to the side member 40. A vertical member 56 connects between the distal ends of the side members 40 and 55. This embodiment provides additional structure for the opposing sides 22 and 24 of the cleat crate 10. The members 55 provide additional stapling surfaces to join the wing ends 38 to the frame 16, thereby increasing torsional racking strength for stacked handling and shipment.

The top frame 16 consists of two wood pieces 60 and 62 that run lengthwise of the crate 10. A pair of end transverse members 64 connect between the wood pieces 60 and 62 at the opposite longitudinal ends of the top frame 16. In the illustrated embodiment, a pair of intermediate transverse members 66 connect between the wood pieces 60 and 62 medial the longitudinal ends. An end strip 68 connects to the lower surface at each of the end transverse members 64. The end strips 68 are spaced inwardly of a respective exterior edge 70 for a purpose discussed below. These elements 60, 62, 64, 66, and 68 may be secured in this arrangement by nails, staples, or other suitable connector. As best shown in FIG. 1, the top frame 16 is dimensioned for being received in an uppermost portion of the cleated-frame crate 10. In the embodiment of FIG. 2, the members 64 and 66 extend outwardly of the side faces 67 of the members 60, 62 for contactingly resting on the member 55 after assembly.

The bottom frame 18 of the wing-end crate 10 in the illustrated embodiment consists of three elongate members 76 that run lengthwise of the crate 10 in a parallel and spaced-apart relationship. A pair of end width members 78 and intermediate width members 80 are secured to the elongate members 76 transverse to their longitudinal axes. The longitudinal ends generally 81 of the width members 78 and 80 preferably extend outwardly of the two members 76 on the sides of the bottom frame 18, for a purpose discussed below. In the illustrated embodiment for containing a garden tractor, a rear wheel support 82 and a front wheel support 84 are likewise rigidly secured to the elongate members 76. The members 76, 78, 80, and 82 are preferably made of a dense hardwood and may be fastened or otherwise secured together by nails, staples, or screws.

The crate 10 provides a rigid frame enclosure for packaging, storing, and shipping an article held on the bottom frame 18. The article is preferably wrapped in a protective plastic shroud (not illustrated) to provide protection against dust, dirt, and the like from coming into contact with the article. The article is mounted to the bottom frame 18. One wing-end frame 12 is picked up from a stack of these frames and positioned with the end 20 adjacent one of the end width members 78 at the longitudinal end of the bottom frame 18. The lower distal ends 52*a* of the interior cleats 51 contact and are supported by the end width member 78 of the bottom frame 80. The hinge corners 26 are adjacent the end corners of the bottom frame 18. The plates 28 are folded along the scores 30 to bring the side frames 38 into alignment with the sides of the bottom frame 18. The cleats 30 and 32 thereby define intersecting planes relative to each other. In the illustrated embodiment, the cleats 30 and 32 intersect at a substantially 90° angle to form a perpendicularly facing corner post for the cleated-frame crate 10.

Assembling one wing-end frame to the base frame defines portions of the opposing sides 22 and 24 of the cleated crate 10 at the respective longitudinal end. The side members 40 are thereby juxtaposed against respective ones of the elongated members 76 of the base frame 18. The side member 40 is received against the elongate member 76 and under the extended overhanging edge 81 of the width members 78 and 80. The wing-end frames 12 are thereby substantially self-aligning with the base frame 18. The side members 40 are then rigidly secured to the elongated members 76 with nails, staples, or other suitable means. The nails or staples are rapidly driven through the member 40 into the bottom frame 18 by the use of pneumatic air gun. A second wing-end frame 12 is similarly positioned and secured to the opposite longitudinal end of the bottom frame 18.

The two unitary wing-end frames 12 are assembled more quickly to the base frame 18 than are conventional cleat crates having two sides and two ends for assembly. Also, fewer workers on the packing line are required for assembling the crate 10. Costs are thereby reduced while the container provides improved protection for the article contained in the crate, as discussed below. Reduced assembly time accommodates the speed of the assembly line by reducing the potential for a bottleneck during the last assembly process of the line.

The top frame 16 is inserted into the upper end of the assembled cleated crate 10. The distal ends of the members 60 and 62 rest on the respective upper distal ends 52*a* of the interior cleats 51. The end strips 68 are thereby juxtaposed against the respective end members 48 and are rigidly connected together by nails, staples, or screws.

The vertical cleats 14 are then installed between the top frame members 60, 62 and the base runners 76 to provide center support intermediate the ends 20. These pieces also help resist bending of the bottom frame during fork truck handling, by effectively reducing the open span of the member 76 and 60, 62. The notches 21 preferably have depths equal to the thickness 53 of the long runner 62 and engage the side members 76 and 60, 62. Staples driven through the cleats 14 connect the cleat to the bottom frame 18 and the top frame 16. In an alternate embodiment (not illustrated) an elongated side member rigidly connects to the respective aligned support members 44 on the sides 22 and 24 of crate 10, for further support.

As may be appreciated with reference to FIG. 1, the crate 10 of the present invention does not have full-length sides as does a standard crate. The side frames 38 preferably occupy between ¼ and ⅓ of the length of the crate. In a preferred embodiment, the crate 10 contains approximately 75% as much lumber as a conventional cleat crate. This reduces material costs as well as the weight of the crate 10. Green mixed hardwood typically weighs about 3.5 pounds per board foot. A standard crate for a lawn and garden tractor for example has approximately 30 board feet and weighs about 105 pounds. A comparable wing crate 10 of the present invention has approximately 22 board feet and weighs about 75 pounds. This difference provides substantial savings in both material costs and transportation costs.

In a preferred embodiment, the heavy 90 point solid fiber hinge corners 26 give increased racking strength over the stapled corners of a conventional cleated crate. Such conventional crates, the tensile and shear strength of the staples themselves are the determining factor in diagonal corner strength. Diagonal corner strength is important in stacked shipment and warehouse stacking of loaded crates 10. In the wing-end crate of the present invention, the solid fiber plates 28 give a full depth joint at the corners of the crate 10 with significantly increased stacking strength. In a preferred embodiment, the solid fiber plates 28 are fully laminated to the double wood vertical posts 32 and 34 while a conventional crate depends on a few staples in two or three areas of each corner where side slats and end slats overlap to offer a stapling joint area. The plates 28 also can be color coded or printed with part numbers, brand names, or other information to aid in identification of the product held in the container.

As discussed above, the side members 40 lock under the overhanging 81 deck boards 78 and 80 of the bottom frame 18. This facilitates self-aligning of the sides and ends of the crate as the wing end frames 12 matingly engage the bottom frame 18. The crate 10 is thereby substantially self-squaring. Further, the crate 10 has sufficient compressive strength for handling by squeeze or clamp-type fork trucks used at warehouses to pick up and move containers. The interlocking of the side portions of the wing-end frames 12 resist the bottom frame 18 from separating from the wing-end frames due to the weight of the article in the container 10 during handling by clamp or squeeze trucks.

Because the wing crate 10 does not require the corners to be stapled together during packing line assembly, fewer fasteners are necessary in order to secure the container together. Assembly is facilitated by the self-aligning feature of the wing-end frames 12 with the base frame 18 and the use of air gun driven screws instead of staples or nails. The screws also can be removed at the receiving destination. This allows the possibility of return of the knocked-down disassembled crate for re-use. Standard crates must be sawn apart or torn apart with crowbars and hammers. This destroys some of the parts and restricts the re-use of parts.

The foregoing has disclosed an improved cleated crate using wing-end frames for packing, shipping, and storing heavy articles. It should be understood that the above-described embodiments merely illustrate principles of the invention in preferred forms. Many modifications, additions, and deletions may come of course, be made thereto without departure from the spirit and scope of the invention as set forth in the following claims.

What is claimed is:

1. A cleated crate having wing-ends, comprising:

a base frame for supporting an article to be packed in a cleated crate;

a pair of wing-end frames, each wing-end frame comprising:

two hinge corners, each comprising:

a plate having a score along an axis thereof;

a pair of cleats attached to the plate and spaced-apart from the score to define a gap between the cleats;

the plate for folding on the score as a hinge to dispose the cleats at intersecting planes relative to each other; and a side frame comprising:

at least one side member rigidly attached at one end to a first one of the pair of cleats and extending laterally thereof; and a support member extending diagonally between said first one of the pair of cleats and a distal end of the side member;

a pair of parallel elongated members interconnecting the two hinge corners, whereby the two hinge corners are spaced-apart for defining corner posts on opposing sides of the cleated crate, the members rigidly joined at distal ends to respective second ones of the pair of cleats on the hinged corners; and an end support member attached to and extending diagonally between the second ones of the pair of cleats on the two spaced-apart hinge corners, whereby the wing-end frames lay flat for shipment and form opposing sides and end portions of the cleated crate by folding the hinge corners on their respective scores in a first direction for connection of the wing-end frames to the base frame of the cleated crate; and a top frame dimensioned for receipt by the pair of wing-end frames on opposing ends of the cleated crate.

2. The cleated crate as recited in claim 1, further comprising a pair of vertical cleats, one of each pair disposed on opposing sides intermediate aligned side frames of the pair of wing-end frames.

3. The cleated crate as recited in claim 1, wherein the plate is fibreboard sheet.

4. The cleated crate as recited in claim 1, further comprising a pair of intermediate connectors disposed on opposing sides of the cleated crate and attached at respective distal ends to the base frame and top frame.

5. The cleated crate as recited in claim 1, wherein the side member in the side frame is disposed for alignment with a side of the base frame for being secured thereto during assembly of the cleated crate.

6. The cleated crate as recited in claim 1, wherein said base frame comprises at least two elongate runners and two end members disposed transverse to the runners and attached to the runners at opposing ends, said end members having distal ends that extend outwardly of the runners for receiving a respective one of the side members against the runner and a lower surface of the end member, whereby the wing-end frames are substantially self-aligning with the base frame.

7. The cleated crate as recited in claim 1, wherein each hinge corner further comprises an interior cleat attached thereto and disposed parallel to a longitudinal axis of the hinge corner whereby the hinge corner, being attached to the base frame, has a first distal end of the interior cleat in contact with an upper surface of a member of the base frame and a second distal end of the intermediate cleat in contact with the top frame, whereby the top load forces on the cleated crate are at least partially transmitted by the interior cleat from the top frame to the base frame and the interior cleat facilitates the alignment of the wing-end frame with the base frame.

8. A method of forming a cleated crate having wing-ends for packing a heavy article, comprising the steps of:

(a) placing an article to be held in a cleated crate on a base frame;

(b) positioning a wing-end frame on each opposing end of the base frame with a first one of a pair of elongated members in each wing frame disposed adjacent a respective end of the base frame, said wing-end frame comprising two hinge corners connected together, each hinge comer comprising:

a plate having a score along an axis thereof;

a pair of cleats attached to the plate and spaced apart from the score to define a gap between the cleats, the plate for folding on the score as a hinge to dispose the cleat at intersecting planes relative to each other; and a side frame comprising:

at least one side member rigidly attached at one end to a first one of the pair of cleats and extending latterly thereof, and a support member extending diagonally between said first one of the pair of cleats and a distal end of said side member:

the pair of elongated members rigidly joined at distal ends to a respective second one of the pair of cleats in the hinge comers to interconnect the two hinge corners whereby the two hinge corners are spaced apart for defining corner posts on opposing sides of the cleated crate; and an end support attached to and extending diagonally between the second ones of the pairs of cleats in the two spaced apart hinge corners, whereby the wing-end frames lay flat for shipment and form opposing sides and end portions of a cleated crate by folding the hinge corner on the respective scores in a first direction for connection of the wing-end frames to the base frame of the cleated crate, (c) folding the plates of the corner hinges on the scores in a first direction to dispose the side frames along respective opposing sides of the base frame;

(d) securing the wing-end frames to the base frame;

(e) positioning a top frame on an upper extent of the wing-end frames; and (f) securing the top frame to the wing-end frames.

* * * * *